US010286709B2

(12) United States Patent
Yoneyama et al.

(10) Patent No.: US 10,286,709 B2
(45) Date of Patent: May 14, 2019

(54) THERMAL TRANSFER SHEET, THERMAL TRANSFER IMAGE-RECEIVING SHEET, METHOD FOR FORMING PRINTED PRODUCT, AND PRINTED PRODUCT

(71) Applicant: Dai Nippon Printing Co., Ltd., Tokyo (JP)

(72) Inventors: Yasushi Yoneyama, Tokyo (JP); Hiroyuki Yamashita, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/566,292

(22) PCT Filed: Apr. 15, 2016

(86) PCT No.: PCT/JP2016/062125
§ 371 (c)(1),
(2) Date: Oct. 13, 2017

(87) PCT Pub. No.: WO2016/167351
PCT Pub. Date: Oct. 20, 2016

(65) Prior Publication Data

US 2018/0079245 A1 Mar. 22, 2018

(30) Foreign Application Priority Data

Apr. 15, 2015 (JP) ..... 2015-083546

(51) Int. Cl.
*B41M 5/382* (2006.01)
*B41M 5/42* (2006.01)
(Continued)

(52) U.S. Cl.
CPC ..... *B41M 5/42* (2013.01); *B41M 5/38214* (2013.01); *B41M 5/426* (2013.01);
(Continued)

(58) Field of Classification Search
CPC .... B41M 5/382; B41M 5/38214; B41M 5/40; B41M 5/42; B41M 5/50; B41M 5/502;
(Continued)

(56) References Cited

U.S. PATENT DOCUMENTS 4,923,848 A 5/1990 Akada et al.
6,316,385 B1 11/2001 Usuki et al.
(Continued)

FOREIGN PATENT DOCUMENTS

EP 1 752 307 A1 2/2007
EP 1 958 787 A1 8/2008
(Continued)

OTHER PUBLICATIONS

International Search Report and Written Opinion (Application No. PCT/JP2016/062125) dated Jun. 28, 2016.
Extended European Search Report, European Application No. 16 780 142.2, dated Dec. 13, 2018 (7 pages).

*Primary Examiner* — Gerard Higgins
(74) *Attorney, Agent, or Firm* — Burr & Brown, PLLC

(57) ABSTRACT

The present invention provides a thermal transfer sheet which can provide a thermal transfer image-receiving sheet capable of forming a printed product of high designability, provides a thermal transfer image-receiving sheet capable of forming a printed product of high designability and a method for forming a printed product, and provides a printed product of high designability.
In a thermal transfer sheet 100 in which a transfer layer 10 is provided on a substrate 1, the transfer layer 10 has a layered structure in which a receiving layer 2, an intermediate layer 3, and a masking layer 4 are layered in this order from the side of the substrate 1, and the intermediate layer 3 contains inorganic particles.

4 Claims, 3 Drawing Sheets

(51) Int. Cl.

| | |
|---|---|
| ***B41M 5/52*** | (2006.01) |
| *B41M 5/44* | (2006.01) |
| *B41M 7/00* | (2006.01) |

(52) U.S. Cl.

CPC ..... *B41M 5/52* (2013.01); *B41M 5/44* (2013.01); *B41M 5/529* (2013.01); *B41M 5/5254* (2013.01); *B41M 5/5272* (2013.01); *B41M 7/0027* (2013.01); *B41M 2205/02* (2013.01); *B41M 2205/30* (2013.01); *B41M 2205/32* (2013.01); *B41M 2205/38* (2013.01)

(58) Field of Classification Search

CPC ..... B41M 5/506; B41M 2205/04; B41M 2205/38; B41M 2205/40

USPC ..... 428/32.39, 32.52, 32.69, 32.75–32.79

See application file for complete search history.

(56) References Cited

U.S. PATENT DOCUMENTS

| | | | |
|---|---|---|---|
| 2008/0274310 | A1 | 11/2008 | Fukui et al. |
| 2009/0130348 | A1 | 5/2009 | Yamashita et al. |

FOREIGN PATENT DOCUMENTS

| | | | |
|---|---|---|---|
| JP | S62-238791 | A1 | 10/1987 |
| JP | H05-278356 | A1 | 10/1993 |
| JP | H05-294081 | A1 | 11/1993 |
| JP | H06-008677 | A1 | 1/1994 |
| JP | H06-122281 | A1 | 5/1994 |
| JP | H07-205560 | A1 | 8/1995 |
| JP | H08-156432 | A1 | 6/1996 |
| JP | 2002-187369 | A | 7/2002 |
| JP | 2002-362068 | A1 | 12/2002 |
| JP | 2008-155612 | A1 | 7/2008 |
| WO | 2006/049221 | A1 | 5/2006 |

THERMAL TRANSFER SHEET, THERMAL TRANSFER IMAGE-RECEIVING SHEET, METHOD FOR FORMING PRINTED PRODUCT, AND PRINTED PRODUCT

BACKGROUND OF THE INVENTION

1. Field of the Invention

The present invention relates a thermal transfer sheet, a thermal transfer image-receiving sheet, a method for forming a printed product, and a printed product.

2. Description of Related Art

As a device for forming a printed product on a transfer receiving article without restriction, an intermediate transfer medium in which a transfer layer including a receiving layer is peelably provided on a substrate has been used (for example, Patent Literature 1). According to this intermediate transfer medium, a printed product where a thermally transferable image has been formed on an optional transfer receiving article can be obtained by forming the thermally transferable image on the receiving layer of the intermediate transfer medium by means of a thermal transfer sheet having a colorant layer, and then transferring the transfer layer including this receiving layer onto the optional transfer receiving article.

Incidentally, some optional transfer receiving articles may have a hologram image or thermally transferable image (hereinbelow, such hologram images or thermally transferable images are collectively referred to as patterns of the transfer receiving article) on their surface in advance. In the case where the transfer layer of the above intermediate transfer medium is transferred onto this transfer receiving article, a pattern formed on the receiving layer constituting the transfer layer transferred onto the transfer receiving article is superposed on the pattern of the transfer receiving article to thereby form an overlay image. Depending on the form of usage of the printed product, there is a demand to obtain, not such an overlay image, a printed product in which the pattern of the transfer receiving article is masked while a thermally transferable image is formed on the masked portion. Under these circumstances, there has been proposed a thermal transfer sheet in which a portion of the pattern of the transfer receiving article is masked while a thermally transferable image can be formed on the pattern masked (for example, Patent Literature 2).

The thermal transfer sheet proposed in Patent Literature 2 is provided with a transfer layer in which a transparent receiving layer and a white masking layer are layered in this order on a substrate. By transferring the transfer layer onto a portion of the transfer receiving article, it is possible to obtain a thermal transfer image-receiving sheet which masks the pattern of the transfer receiving article while enabling formation of a thermally transferable image on the masked portion. Then, by forming a thermally transferable image on the transparent receiving layer of the thermal transfer image-receiving sheet obtained, it is possible to obtain a printed product in which an optional pattern of the transfer receiving article is masked while the thermally transferable image is formed on the masked portion.

However, the thermal transfer sheet as proposed in Patent Literature 2 has a problem of failing to sufficiently increase the designability of a printed product to be finally formed with respect to the density of the thermally transferable image to be formed on the receiving layer of the transfer layer, the transferring property when the transfer layer is transferred and the like, which leaves room for improvement.

CITATION LIST

Patent Literature

Patent Literature 1: Japanese Patent Laid-Open No. 62-238791 A

Patent Literature 2: Japanese Patent Laid-Open No. 6-122281 A

SUMMARY OF THE INVENTION

Technical Problem

The present invention has been made in view of the above-mentioned circumstances, and the present invention aims principally to provide a thermal transfer sheet which can provide a thermal transfer image-receiving sheet capable of forming a printed product of high designability, to provide a method for forming a thermal transfer image-receiving sheet capable of forming a printed product of high designability or a printed product, and to provide a printed product of high designability.

Solution to Problem

The present invention for solving the above problems is a thermal transfer sheet in which a transfer layer is provided on a substrate, wherein the transfer layer has a layered structure in which a receiving layer, an intermediate layer, and a masking layer are layered in this order from the side of the substrate, and the intermediate layer contains inorganic particles.

Alternatively, the transfer layer and a dye layer laminate are provided on the same surface of the substrate successively in a surface by surface manner, the dye layer laminate has a layered structure in which a dye primer layer and a dye layer are layered in this order from the side of the substrate, and the dye primer layer may contain inorganic particles.

The inorganic particles may be inorganic particles derived from colloidal inorganic particles.

The present invention for solving the above problems is also a thermal transfer image-receiving sheet in which a pattern layer, a masking layer, an intermediate layer, and a first receiving layer are provided in this order on a substrate, wherein a portion of the surface of the pattern layer is exposed and the intermediate layer contains inorganic particles.

The inorganic particles may be inorganic particles derived from colloidal inorganic particles.

The pattern layer may also be a pattern layer in which a hologram layer and a second receiving layer are layered from the top of the substrate.

The present invention for solving the above problems is also a printed product in which a thermally transferable image is formed on the first receiving layer of the thermal transfer image-receiving sheet.

The present invention for solving the above problems is also a method for forming a printed product, wherein the method comprises preparing a transfer receiving article and a thermal transfer sheet, the transfer receiving article being provided with a pattern layer, the thermal transfer sheet having a thermal transfer layer and a dye layer laminate formed on a same surface of a substrate frame sequentially, the thermal transfer layer comprising a receiving layer, an intermediate layer containing inorganic particles, and a masking layer layered in this order from the surface of the substrate, the dye layer laminate comprising a dye primer layer containing inorganic particles and a dye layer layered in this order from the surface of the substrate; transferring the transfer layer of the thermal transfer sheet on the pattern layer as being exposed a portion of the surface of the pattern layer externally; and forming a thermally transferable image on the transfer layer transferred onto the pattern layer by using the dye layer included in the dye layer laminate of the thermal transfer sheet.

Effect of the Invention

According to the thermal transfer sheet of the present invention, it is possible to obtain a thermal transfer image-receiving sheet capable of forming a printed product of high designability. According to the thermal transfer image-receiving sheet and the method for forming a printed product of the present invention, it is also possible to form a printed product of high designability. According to the printed product of the present invention, it is also possible to increase the designability of the printed product of the present invention.

BRIEF DESCRIPTION OF DRAWINGS

FIG. 5(*b*) is a schematic sectional view illustrating one example of a thermal transfer image-receiving sheet of one embodiment.

FIG. 5(*c*) is a schematic sectional view illustrating one example of a thermal transfer image-receiving sheet of one embodiment.

FIG. 6(*b*) is a schematic sectional view illustrating one example of a printed product of one embodiment.

DETAILED DESCRIPTION OF THE INVENTION

<<Thermal Transfer Sheet>>

Figure 1:
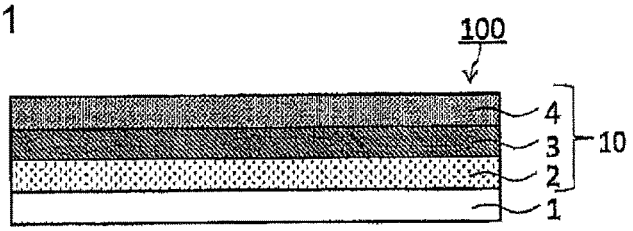
FIG. 1 is a schematic sectional view illustrating one example of a thermal transfer sheet of one embodiment.

The thermal transfer sheet 100 of one embodiment of the present invention (hereinbelow, the sheet is referred to as the thermal transfer sheet of one embodiment) has a transfer layer 10 provided on a substrate 1, and the transfer layer 10 has a layered structure in which a receiving layer 2, an intermediate layer 3, and a masking layer 4 are layered in this order from the side of the substrate 1, as shown in FIG. 1. In each figure, the thickness of each layer to be provided on the substrate and the like are exaggeratedly shown.

Figure 4:
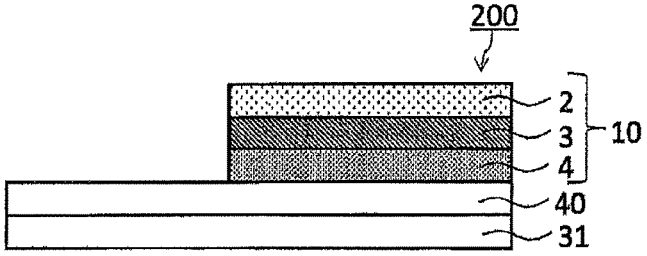
FIG. 4 is a schematic sectional view illustrating one example of a thermal transfer image-receiving sheet of one embodiment.

The thermal transfer sheet 100 of one embodiment is a thermal transfer sheet used for obtaining a thermal transfer image-receiving sheet 200 as shown in FIG. 4, for example. Specifically, by transferring the transfer layer 10 of the thermal transfer sheet 100 onto an optional transfer receiving article (hereinbelow, the article is referred to as a transfer receiving article) such that a portion of the surface on the transfer receiving article is exposed, a thermal transfer image-receiving sheet in which the transfer layer 10 is provided on the transfer receiving article is obtained. Specifically, a thermal transfer image-receiving sheet 200 in which the masking layer 4, the intermediate layer 3, and the receiving layer 2 are layered in this order on the transfer receiving article is obtained by allowing a portion of the surface of the transfer receiving article to be exposed. Next, the respective constituents which constitute the thermal transfer sheet 100 will be specifically explained.

(Substrate)

The substrate 1 is an essential constituent in the thermal transfer sheet 100 of one embodiment, and it is provided in order to support the transfer layer 10 provided on one surface of the substrate 1 and a back face layer optionally provided on the other surface of the substrate 1. There is no particular limitation with respect to the material of the substrate 1, but the material desirably endures the heat applied when the transfer layer 10 is transferred onto the transfer receiving article and has a mechanical strength to the extent of being able to handle without a hitch. As the substrate 1 like this, various plastic films or sheets such as polyesters such as polyethylene terephthalate, polycarbonate, polyimide, polyether imide, cellulose derivatives, polyethylene, polypropylene, polystyrene, acryl, polyvinyl chloride, polyvinylidene chloride, nylon, polyether ether ketone, and the like can be exemplified. The thickness of the substrate 1 can be appropriately set depend on the materials such that the strength and heat resistance will be suitable. The thickness is generally in the range of 2.5 μm or more and 100 μm or less.

(Transfer Layer)

The transfer layer 10 is provided on the substrate 1. The transfer layer 10 has a layered structure in which the receiving layer 2, the intermediate layer 3, and the masking layer 4 are layered in this order from the side of the substrate 1. The transfer layer 10 is provided peelably from the substrate 1 and is a layer to be transferred onto a transfer receiving article when thermally transferred.

(Masking Layer)

The masking layer 4, constituting the transfer layer 10, is a layer having a function of masking a portion of the surface of a transfer receiving article onto which the transfer layer 10 has been transferred. One example of the masking layer 4 is constituted by a binder resin and a colorant. As such a binder resin, polyester resins, urethane resins, epoxy resins, melamine resins, alkyd resins, phenol resins, acryl resins, vinyl chloride-vinyl acetate copolymer resins, and the like can be exemplified. As the colorant, known colorants such as titanium oxide, zinc oxide, carbon black, iron oxide, yellow iron oxide, ultramarine, metallic pigments, pearl pigments and the like can be exemplified. The masking layer 4 may contain one of these binder resins or may contain two or more of these. The same applies to the colorant.

There is no particular limitation with respect to the method for forming the masking layer 4, and the masking layer 4 may be formed by dispersing or dissolving the binder resin exemplified as above, a colorant, and optionally, additives if necessary in an appropriate solvent to prepare a coating liquid for the masking layer, coating the intermediate layer 3 with the thus prepared coating liquid using a conventionally known forming device such as the gravure coating method, the roll coat method, the screen printing method, the reverse roll coating method using a gravure plate, or the like, and then drying the coating liquid.

There is no particular limitation with respect to the thickness of the masking layer 4, and the thickness may be appropriately set in consideration of the masking property by the masking layer 4. When the thickness of the masking layer 4 is less than 0.1 μm, the masking property tends to decrease. Considering this point, the thickness of the masking layer 4 is preferably 0.1 μm or more. The preferable upper value of the masking layer is not particularly limited, and it may be of the order of 5 μm.

(Receiving Layer)

The receiving layer 2, which constitutes the transfer layer 10, is a layer located nearest the substrate 1 of the layers constituting the transfer layer 10.

There is no particular limitation with respect to the binder resin contained in the receiving layer 2, and as the binder resin, polyolefin-based resins such as polypropylene, halogenated resins such as polyvinyl chloride and polyvinylidene chloride, vinyl-based resins such as polyvinyl acetate, vinyl chloride-vinyl acetate copolymers, ethylene-vinyl acetate copolymers or polyacrylic esters, polyester-based resins such as polyethylene terephthalate or polybutylene terephthalate, polystyrene-based resins, polyamide-based resins, copolymer-based resins of an olefin such as ethylene or propylene and another vinyl polymer, ionomer or cellulose-based resins such as cellulose diastase, polycarbonate, and solvent-based resins such as acrylic-based resins can be exemplified.

Instead of the solvent-based resins exemplified as above, aqueous resins such as water-soluble resins, water-soluble polymers, and water-based resins can be used as the binder resin.

According to the receiving layer 2 containing an aqueous resin, it is possible to form an image having a higher printing density and also to increase the lightfastness and glossiness after image formation, compared with a solvent-based receiving layer.

As the above water-soluble resins and water-soluble polymers, polyvinyl pyrrolidone resins, polyvinyl alcohol resins, gelatin and the like can be exemplified. As the water-based resins, resins in which a portion of the solvent is constituted by water, such as emulsions or dispersions of polyvinyl chloride-based resins, acrylic-based resins, urethane-based resins and the like can be exemplified. The above water-based resins can be formed by preparation by, for example, dispersing a solution containing a solvent-based resin by a method such as a homogenizer.

The receiving layer 2 may contain one binder or may contain two or more binders.

The receiving layer 2 preferably contains a release agent. Allowing the receiving layer 2 to contain a release agent can improve the releasability (it may also be referred to as exfoliation) of the transfer layer 10 from the substrate 1 and can also make the releasability between the receiving layer 2 and the dye layer satisfactory when this transfer layer 10 is transferred onto a transfer receiving article to form a thermal transfer image-receiving sheet and the dye of the dye layer is transferred onto the receiving layer located on the outermost surface of the thermal transfer image-receiving sheet to form a thermally transferable image. Combining a binder resin having excellent releasability from the substrate 1, for example, the binder resin exemplified as above with an optional binder resin for the release layer described later, as the binder resin for the receiving layer, can satisfy the releasability of the transfer layer 10 without allowing a release agent to be contained.

As the release agent, solid waxes such as polyethylene wax, amide wax, and Teflon® powder, fluorine-based or phosphoric acid ester-based surfactants, silicone oils, various modified silicone oils such as reactive silicone oils and curable silicone oils, various silicone resins, and the like can be exemplified.

The content of various binder resins described above is preferably 50% by mass or more based on the total solid content of the receiving layer 2. Particularly, by setting the content of the water-soluble resin, water-soluble polymer or water-based resin within the above range, it is possible to impart higher glossiness to an image to be formed. The same applies to a case where a binder resin other than this may be applied.

The receiving layer 2 may be formed by dispersing or dissolving the binder resin exemplified as above and optionally, additives if necessary in an appropriate solvent to prepare a coating liquid for the receiving layer, coating the substrate 1 with the thus prepared coating liquid using a device such as the gravure printing method, the screen printing method, the reverse roll coating method using a gravure plate, or the like, and then drying the coating liquid. There is no particular limitation with respect to the thickness of the receiving layer 2, and the thickness is usually in the range of 0.3 μm or more and 10 μm or less.

By providing a release layer (not shown) between the substrate 1 and the transfer layer 10 instead of allowing the receiving layer 2 to contain a release agent or while allowing the receiving layer 2 to contain a release agent, the releasability of the transfer layer 10 from the substrate 1 can be improved. The release layer, which is an optional constituent in the thermal transfer sheet 100 of one embodiment, is a layer not constituting the transfer layer 10. In other words, the release layer is a layer not to be transferred onto the transfer receiving article when the transfer layer 10 is transferred onto the transfer receiving article.

As the binder resin constituting the optional release layer, waxes, silicone wax, silicone resins, silicone-modified resins, fluorine resins, fluorine-modified resins, polyvinyl alcohol resins, polyimide resins, polyamide resins, polyamide imide resins, acrylic-based resins, thermally crosslinkable epoxy-amino resins, thermally crosslinkable alkyd-amino resins, and the like can be exemplified. As the binder resin constituting the release layer, one of the resins may be used solely, or two or more of these may be used in combination.

(Intermediate Layer)

The intermediate layer 3 is provided between the receiving layer 2 and the masking layer 4 described above. The intermediate layer 3, which is a layer, together with the receiving layer 2 and the masking layer 4, constituting transfer layer 10, is an essential constituent in the thermal transfer sheet 100 of one embodiment.

The thermal transfer sheet 100 of one embodiment is characterized in that the intermediate layer 3 contains inorganic particles. According to the thermal transfer sheet 100 of one embodiment comprising the intermediate layer 3 containing inorganic particles, it is possible to make the foil cutting property when the transfer layer 10 is transferred onto a transfer receiving article satisfactory. Specifically, it is possible to reduce defective transfer such as tailing, character collapse and the like when the transfer layer 10 is transferred. Additionally, according to the thermal transfer sheet 100 of one embodiment, it is possible to make the printing density satisfactory, when the transfer layer is transferred onto a transfer receiving article to form a thermal transfer image-receiving sheet 200 and a thermally transferable image is formed on the receiving layer 2 of the thermal transfer image-receiving sheet 200. Tailing referred to herein means a phenomenon in which, when the transfer layer is transferred onto a transfer receiving article, the transfer layer is transferred such that the transfer layer protrudes, starting from the boundary between the transfer region and the non-transfer region of the transfer layer, onto the non-transfer region. Character collapse referred to herein means a phenomenon in which a non-transfer region surrounded by or sandwiched between transfer regions is transferred due to a phenomenon similar to tailing and thus the original character cannot be reproduced.

An obvious mechanism in which allowing inorganic particles to be contained improves the foil tearing property of the transfer layer 10 has not been fully clarified yet, but it is assumed that allowing the intermediate layer 3 to contain inorganic particles improves the shearing property of the intermediate layer 3 and this improvement in the shearing property contributes to an improvement of the foil tearing property of the transfer layer 10 including the intermediate layer 3. Allowing the intermediate layer 3 to contain inorganic particles enables sufficient transmission of heat applied to the thermal transfer sheet 100 when the transfer layer 10 is transferred into the transfer layer 10. It is assumed that this also contribute to an improvement in the foil tearing property of the transfer layer 10.

The mechanism in which allowing inorganic particles to be contained improves the printing density when the transfer layer 10 is transferred onto an transfer receiving article and a thermally transferable image is formed on the receiving layer 2 of this transfer layer 10 has not been fully clarified yet. Providing the intermediate layer 3 containing inorganic particles can diffuse and transfer the dye in the dye layer onto the receiving layer 2 to improve the diffusion efficiency when the thermally transferable image is formed. In other words, it is possible to transmit the thermal energy when the thermally transferable image is formed to the receiving layer 2 without any waste. According to this, it is assumed that the printing density of the thermally transferable image to be formed on the receiving layer 2 of the transfer layer 10 transferred onto the transfer receiving article is improved. Furthermore, by use of the intermediate layer 3 containing inorganic particles, flowing of the dye that has been diffused and transferred in the receiving layer 2 into the intermediate layer 3 can be inhibited. It is assumed that this also improves the printing density of a thermally transferable image to be formed on the receiving layer 2.

Even if not depending on the above mechanism, according to the thermal transfer sheet 100 of one embodiment that includes the intermediate layer containing inorganic particles, it can be revealed from the results of Examples described later that the foil cutting property when the transfer layer 10 is transferred onto the transfer receiving article can be made satisfactory and that it is possible to make an improvement in the printing density when the transfer layer 10 is transferred onto an transfer receiving article to form a thermally transferable image on the receiving layer 2 of this transfer layer 10.

There is no particular limitation with respect to the inorganic particles, and fine particles of alumina, silica, zirconia, tin oxide, magnesium carbonate, magnesium hydroxide, and titanium oxide can be exemplified. Among these, in the case where the intermediate layer 3 containing alumina particles or silica particles is used, compared with the case where the intermediate layer 3 contains inorganic particles other than these, it is possible to further increase the printing density when the transfer layer 10 is transferred onto the transfer receiving article and a thermally transferable image is formed on the receiving layer 2 of this transfer layer 10. From this point, alumina particles and silica particles are preferred inorganic particles.

There is no limitation with respect to the method for forming the intermediate layer 3 as long as the intermediate layer 3 satisfies the conditions of containing inorganic particles. The intermediate layer 3 is preferably formed by using a coating liquid for the intermediate layer containing colloidal inorganic particles. In other words, the intermediate layer 3 preferably contains inorganic particles derived from colloidal inorganic particles. By using colloidal inorganic particles, the intermediate layer 3 having good film-formability can be formed and also, the adhesion between the receiving layer 2 and the masking layer 4 can be made satisfactory. In the case where the intermediate layer 3 contains inorganic particles derived from colloidal inorganic particles, the foil tearing property of the transfer layer 10 and the printing density when the transfer layer 10 is transferred and a thermally transferable image is formed on the receiving layer 2 on this transfer layer 10 can be further improved.

As the colloidal inorganic particles for forming the intermediate layer 3, silica sol, colloidal silica, alumina sol, colloidal alumina (alumina hydrate sol), zirconia sol, tin oxide sol, titania sol, and the like can be exemplified. In the case where further improvements of the foil tearing property when the transfer layer is transferred or of the printing density when a thermally transferable image is formed on the receiving layer 2 of the transfer layer 10 are intended, the intermediate layer 3 preferably contains alumina sol, alumina particles derived from colloidal alumina, silica sol, or silica particles derived from colloidal silica.

The above colloidal inorganic particles may be those treated into an acidic type, may be fine particles having cationic charges, or may be surface-treated, in order to be easily dispersed in a sol state into a solvent or dispersion medium There is no limitation with respect to the shape of the inorganic particles, and the particles may take any shape such as spherical, needle-like, plate-like, pennate, and amorphous shapes. There is also no limitation with respect to the particle size of the inorganic particles. When the intermediate layer 3 mainly contains inorganic particles of which primary particles have a size of more than 10 μm, the transparency of the intermediate layer 3 tends to decrease. Considering this point, the intermediate layer 3 preferably contains mainly inorganic particles of which primary particles have a size of 10 μm or less. "Mainly" means 50% by mass or more based on the total mass of the inorganic particles contained in the intermediate layer 3. The lower limit is not particularly limited, and the size of the primary particles is of the order of 0.01 μm.

There is no particular limitation with respect to the method for forming the intermediate layer 3 by using the colloidal inorganic particles, and the intermediate layer 3 can be formed by coating the receiving layer 2 with a coating liquid for the intermediate layer comprising colloidal inorganic particles, for example, alumina sol by a conventionally known forming device, such as the gravure coating method, the roll coat method, the screen printing method, the reverse roll coating method using a gravure plate or the like, and drying the coating liquid. An aqueous coating liquid for the intermediate layer can be prepared by dispersing colloidal inorganic particles in an aqueous medium. As the aqueous medium, water, water-soluble alcohols such as isopropyl alcohol, mixed liquids such as water and a water-soluble alcohol, and the like can be exemplified. The coating liquid for the intermediate layer preferably contains 1 part by mass or more and 100 parts by mass or less of colloidal inorganic particles based on 100 parts by mass of the aqueous medium.

Although the intermediate layer 3 constituted solely by inorganic particles is described as an example in the above, the intermediate layer 3 may contain a binder resin together with inorganic particles. The binder resin is preferably one capable of improving the adhesion between the receiving layer 2 and the masking layer 4. As such a binder resin, urethane-based resins, polyester-based resins, acrylic-based resins, vinyl-based resins such as vinyl chloride-vinyl acetate-based copolymer resins, polyvinyl pyrrolidone-based resins, polyamide epoxy resins, polyvinyl alcohol resins and the like can be exemplified.

The urethane-based resin referred to herein means a resin containing a polyol (polyhydric alcohol) as the base agent and isocyanate as the crosslinking agent (curing agent). The polyol is one having two or more hydroxyl groups per molecule, and polyethylene glycol, polypropylene glycol, acryl polyol, polyester polyol, polyether polyol, alkyd-modified acryl polyol and the like can be exemplified. The urethane-based resin may be a water-based urethane resin which may form a stable dispersion liquid in an aqueous medium, for example, water, water-soluble alcohols such as isopropyl alcohol, and a mixed liquid of water and a water-soluble alcohol, and may be a solvent-based urethane resin which can be dissolved or dispersed in an organic solvent.

The polyvinyl pyrrolidone-based resin referred to herein means a homopolymer of vinyl pyrrolidone monomers, or a copolymer of vinyl pyrrolidone monomers and other monomers. For example, the polyvinyl pyrrolidone-based resin may be a homopolymer of vinyl pyrrolidone monomers such as vinyl pyrrolidone, such as N-vinyl-2-pyrrolidone or N-vinyl-4-pyrrolidone, that is, polyvinyl pyrrolidone or may be a copolymer of vinyl pyrrolidone and other monomers. As other monomers, vinyl monomers are suitable. As the vinyl monomer, vinyl ethers such as cyclohexyl vinyl ether, ethyl vinyl ether, hydroxyethyl vinyl ether, hydroxybutyl vinyl ether, and hydroxycyclohexyl vinyl ether, fatty acid vinyl esters such as vinyl acetate and vinyl lactate, (meth)acrylic acid esters such as methyl(meth)acrylate, ethyl(meth)acrylate, hydroxyethyl(meth)acrylate, and hydroxypropyl(meth) acrylate, allyl ethers such as hydroxybuthyl allyl ether and ethylene glycol monoallyl ether, and the like can be exemplified. As the copolymer of vinyl pyrrolidone and vinyl monomers, commercially available products can be used. For example, as commercially available products of copolymers of vinyl pyrrolidone and vinyl acetate, Luviskol VA28 and Luviskol VA73 manufactured by BASF SE can be exemplified.

In addition to these, as the polyvinyl pyrrolidone-based resin, polymers containing a derivative in which the pyrrolidone ring has a substituent, such as N-vinyl-3-methyl pyrrolidone, N-vinyl-5-methyl pyrrolidone, N-vinyl-3,3,5-trimethyl pyrrolidone, and N-vinyl-3-benzyl pyrrolidone may be used.

There is no limitation on the content of the inorganic particles and the binder resin in the case where the intermediate layer 3 contains inorganic particles and a binder resin, and the content of the inorganic particles is preferably 5% by mass or more and more preferably 20% by mass or more based on the total mass of the inorganic particles and the binder resin. By setting the content of the inorganic particles within this range, it is possible to make the foil cutting property when the transfer layer 10 is transferred satisfactory and to sufficiently increase the printing density when the transfer layer 10 is transferred onto the transfer receiving article and a thermally transferable image is formed on the receiving layer 2 of the transfer layer 10.

There is no particular limitation with respect to the method for forming the intermediate layer 3 containing the inorganic particles and binder resin, and the intermediate layer 3 may be formed by dispersing or dissolving the binder resin exemplified as above, inorganic particles, optionally, additives if necessary in an appropriate solvent to prepare a coating liquid for the intermediate layer, coating the receiving layer 2 with the thus prepared coating liquid using a conventionally known forming device such as the gravure coating method, the roll coat method, the screen printing method, the reverse roll coating method using a gravure plate, or the like, and then drying the coating liquid. As the inorganic particles contained in the coating liquid for the intermediate layer, colloidal inorganic particles may be used.

There is no particular limitation with respect to the thickness of intermediate layer 3, but when the thickness of the intermediate layer 3 is less than 0.01 μm, the printing density tends to decrease when the transfer layer 10 is transferred onto a transfer receiving article and a thermally transferable image is formed on the receiving layer 2 of this transfer layer 10. When the thickness of the intermediate layer 3 exceeds 5 μm, the foil tearing property of the transfer layer 10 tends to deteriorate. Considering this point, the thickness of the intermediate layer 3 is preferably 0.01 μm or more and 5 μm or less, more preferably 0.02 μm or more and 3 μm or less.

(Back Face Layer)

A back face layer (not shown) may be provided on the surface opposite to the surface of the substrate 1 on which the transfer layer 10 is provided. Incidentally, the back face layer is an optional constituent in the thermal transfer sheet 100 of one embodiment.

There is no limitation with respect to the material of the back face layer, and single resins or mixtures of natural or synthetic resins such as cellulosic resins, such as ethyl cellulose, methyl cellulose, cellulose acetate, cellulose acetate butyrate, nitro cellulose, cellulose acetate butyrate, and cellulose acetate propionate, vinyl-based resins, such as polyvinyl alcohol, polyvinyl acetate, polyvinyl butyral, polyvinyl acetal, and polyvinyl pyrrolidone, acrylic-based resins, such as polymethyl methacrylate, polyethyl acrylate, polyacrylamide, and acrylonitrile-styrene copolymers, polyamide resins, polyamide imide resins, coumarone-indene resins, polyester resins, polyurethane resins, and silicone-modified or fluorine-modified urethanes can be exemplified.

The back face layer may also contain a solid or liquid lubricant. As the lubricant, various waxes, such as polyethylene wax and paraffin wax, higher aliphatic alcohols, organo polysiloxanes, anionic surfactants, cationic surfactants, amphoteric surfactants, nonionic surfactants, fluorine-based surfactants, organic carboxylic acids and derivatives thereof, metal soaps, fluorine-based resins, silicone-based resins, and fine particles of inorganic compounds such as talc and silica and the like can be exemplified. The mass of the lubricant based on the total mass of the back face layer is preferably in the range of 5% by mass or more and 50% by mass or less, more preferably in the range of 10% by mass or more and 30% by mass or less.

There is no particular limitation with respect to the method for forming the back face layer, and the back face layer can be formed by preparing a coating liquid for the back face layer in which a resin, a lubricant to be added as required and the like are dissolved or dispersed in an appropriate solvent, coating the substrate 1 with the thus prepared coating liquid by a conventional coating device such as a gravure coater, a roll coater, and a wire bar, and then drying the coating liquid. The thickness of the back face layer is preferably in the range of 0.3 μm or more and 10 μm or less.

<<Thermal Transfer Sheet of Another Embodiment>>

Figure 2:
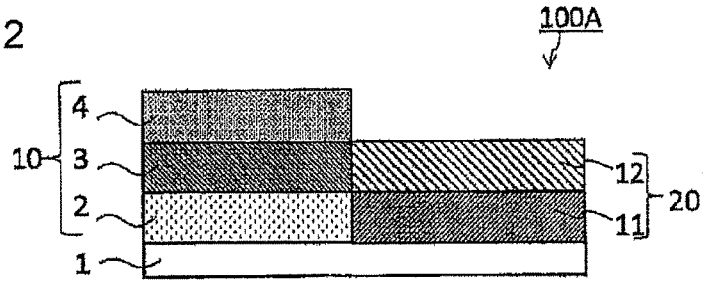
FIG. 2 is a schematic sectional view illustrating one example of a thermal transfer sheet of one embodiment.
Figure 3:
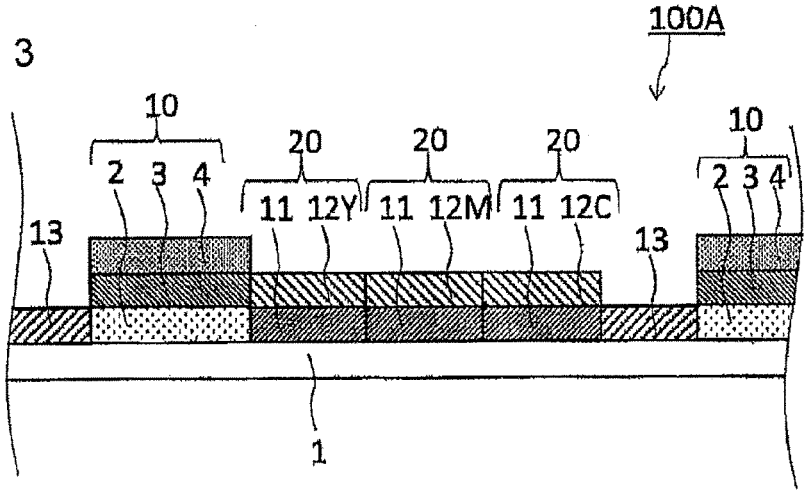
FIG. 3 is a schematic sectional view illustrating one example of a thermal transfer sheet of one embodiment.

In the thermal transfer sheet 100A of another embodiment, as shown in FIG. 2, the transfer layer 10 and the dye layer laminate 20 are provided on the same surface of the substrate 1 successively in a surface by surface manner. The dye layer laminate 20 has a layered structure in which a dye primer layer 11 and a dye layer 12 are layered in this order from the side of the substrate 1. In other words, the thermal transfer sheet 100A of another embodiment takes a configuration where a dye layer laminate 20 is further provided on the same surface on which the transfer layer 10 of the substrate 1 is also provided, in thermal transfer sheet 100 of one embodiment described above. In the thermal transfer sheet 100A of another embodiment shown in FIG. 2, as shown in FIG. 3, the transfer layer 10, the dye layer laminate 20, and an optional protective layer 13 may also be provided on the same surface of the substrate 1 repeatedly and successively in a surface by surface manner. Alternatively, in an embodiment shown in FIG. 3, instead of or together with the optional protective layer 13, an optional coloring agent layer containing a pigment (not shown), an optional special color panel constituted by a hologram layer (not shown) or the like may be provided repeatedly and successively in a surface by surface manner. The order in which these optional layers are provided repeatedly and successively in a surface by surface manner is not limited to the forms shown.

According to the thermal transfer sheet 100A of another embodiment, for example, it is possible to perform both formation of the thermal transfer image-receiving sheet 200 as shown in FIG. 4 and formation of a thermally transferable image onto the receiving layer 2 of the thermal transfer image-receiving sheet formed. Specifically, by transferring the transfer layer 10 onto a transfer receiving article by using the thermal transfer sheet 100A of another embodiment, a thermal transfer image-receiving sheet in which the masking layer 4, the intermediate layer 3 containing inorganic particles, and the receiving layer 2 are layered in this order on the transfer receiving article can be obtained. Allowing the dye contained in the dye layer 12 constituting the dye layer laminate 20 to transfer onto the receiving layer 2 of the thermal transfer image-receiving sheet 200 obtained by transferring the transfer layer 10 onto a transfer receiving article enables formation of a thermally transferable image.

The above thermal transfer sheet 100A of another embodiment is characterized in that the dye primer layer 11 constituting the dye layer laminate 20 contains inorganic particles. According to the thermal transfer sheet 100A of another embodiment having this characteristic, in addition to the effect described for the thermal transfer sheet 100 of the above one embodiment, in other words, the improvement in the foil tearing property when the transfer layer 10 is transferred, it is possible to make a further improvement in the printing density by transferring the transfer layer 10 onto a transfer receiving article and transferring the dye of the dye layer laminate 20 onto the receiving layer 2 of this transfer layer 10 to thereby form a thermally transferable image. Hereinafter, the respective constituents of the thermal transfer sheet 100A of another embodiment will be explained with focusing on differences between the thermal transfer sheet 100A and the thermal transfer sheet 100 of one embodiment. Unless otherwise particularly specified, as for constituents other than the dye layer laminate 20, ones described in the thermal transfer sheet 100 of one embodiment can be used as they are.

(Dye Layer Laminate)

In the thermal transfer sheet 100A of another embodiment, the transfer layer 10 described above and the dye layer laminate 20 are provided on the same surface of the substrate 1 successively in a surface by surface manner. The dye layer laminate 20 has a layered structure in which a dye primer layer 11 and a dye layer 12 are layered in this order from the side of the substrate 1.

(Dye Layer)

The dye layer 12 constituting the dye layer laminate 20 contains a sublimable dye and a binder resin. In the dye layer 12, a layer of one color selected appropriately may be formed when the desired image is a monochromatic image, or a plurality of dye layers each containing a sublimable dye having a different hue, such as a yellow dye 12Y, a magenta dye 12M, and a cyan dye 12C may be repeatedly formed on the same surface of the same substrate successively in a surface by surface manner, when the desired image is a full-color image, as shown in FIG. 3. In the embodiment shown in FIG. 3, although the transfer layer 10, the yellow dye 12Y, the magenta dye 12M, the cyan dye 12C, and the protective layer 13 are repeatedly formed in this order on the same surface of the substrate, the layers may not be repeatedly formed. Alternatively, the layers may not be formed in this order.

<<Sublimable Dye>>

There is no particular limitation with respect to the sublimable dye, and those having a sufficient color density and resistance to discoloration and fading due to light, heat, temperature and the like are preferred. As such a sublimable dye, diaryl methane-based dyes, triaryl methane-based dyes, thiazole-based dyes, merocyanine dyes, pyrazolone dyes, methine-based dyes, pyrazolomethine-based dyes, indoaniline-based dyes, azomethine-based dyes such as acetophenoneazomethine, pyrazoloazomethine, imidazoleazomethine, imidazoazomethine, and pyridoneazomethine, xanthene-based dyes, oxazine-based dyes, cyanostyrene-based dyes such as dicyanostyrene and tricyanostyrene, thiazine-based dyes, azine-based dyes, acridine-based dyes, benzeneazo-based dyes, azo-based dyes such as, pyridoneazo, thiopheneazo, isothiazoleazo, pyrroleazo, pyrazoleazo, imidazoleazo, thiadiazoleazo, triazoleazo, and disazo, spiropyran-based dyes, indolinospiropyran-based dyes, fluoran-based dyes, rhodaminelactam-based dyes, naphthoquinone-based dyes, anthraquinone-based dyes, quinophthalone-based dyes and the like can be exemplified. Specifically, red dyes such as MS Red G (manufactured by Mitsui Toatsu Chemicals Co., Ltd.), Macrolex Red Violet R (manufactured by Bayer AG), CeresRed 7B (manufactured by Bayer AG), and Samaron Red F3BS (manufactured by Mitsubishi Chemical Corporation), yellow dyes such as Holon Brilliant yellow 6GL (manufactured by Clariant), PTY-52 (manufactured by Mitsubishi Chemical Industries, Ltd.), and MACROLEX Yellow 6G (manufactured by Bayer AG), and blue dyes such as Kayaset Blue 714 (manufactured by Nippon Kayaku Co., Ltd.), Waxoline Blue AP-FW (manufactured by ICI), Holon Brilliant Blue S-R (manufactured by Sandoz), MS Blue 100 (Mitsui Toatsu Chemicals Co., Ltd.), C.I. Solvent blue 63, and the like can be exemplified.

The content of the sublimable dye is preferably in the range of 50% by mass or more and 350% by mass, more preferably in the range of 80% by mass or more and 300% by mass, based on the total solid content of the binder resin described later. When the content of the sublimable dye is less than the above range, the printing density tends to decrease. When the content of the sublimable dye exceeds the above range, the preservability and the like tend to decrease.

<<Binder Resin>>

There is no particular limitation with respect to the binder resin which is contained in the dye layer and used for carrying the above sublimable dye, and those having a certain degree of heat resistance and having a moderate affinity with the sublimable dye can be used. As such a binder resin, cellulosic resins, such as ethyl cellulose, methyl cellulose, cellulose acetate, cellulose acetate butyrate, nitro cellulose, cellulose acetate butyrate, and cellulose acetate propionate, vinyl-based resins, such as polyvinyl alcohol, polyvinyl acetate, polyvinyl butyral, polyvinyl acetoacetal, and polyvinyl pyrrolidone, acryl resins such as poly(meth)acrylate and poly(meth)acrylamide, polyurethane-based resins, polyamide-based resins, polyester-based resin, and the like can be exemplified.

There is no particular limitation with respect to the content of the binder resin, but when the content of the binder resin based on the total solid content of the dye layer 12 is less than 20% by mass, it is not possible to sufficiently retain the sublimable dye in the dye layer 12, and thus the preservability tends to decrease. Therefore, the binder resin is preferably contained in an amount of 20% by mass or more based on the total solid content of the dye layer 12. There is no particular limitation with respect to the upper limit of the content of the binder resin, and the upper limit can be set as appropriate depending on the content of the sublimable dye and optional additives.

The dye layer 12 may also contain additives such as inorganic particles and organic particulates. As the inorganic particles, talc, carbon black, aluminum, molybdenum disulfide and the like can be exemplified, and as the organic particulates, polyethylene waxes, silicone resin particulates, and the like can be exemplified. The dye layer 12 may contain a release agent. As the release agent, modified or non-modified silicone oils (including those called silicone resins), phosphoric acid ester, fatty acid esters, and the like can be exemplified.

There is no particular limitation with respect to the method for forming the dye layer 12, and the dye layer 12 can be formed by dispersing or dissolving the binder resin, the sublimable dye, optionally, additives if necessary and the release agent in an appropriate solvent to prepare a coating liquid for the dye layer, coating the dye primer layer 11 described later with the thus prepared coating liquid for the dye layer using a conventionally known coating device such as a gravure coater, a roll coater, and a wire bar, and then drying the coating liquid. The thickness of the dye layer is generally in the range of 0.2 μm or more and 2 μm or less.

(Dye Primer Layer)

The dye primer layer 11 constituting the dye layer laminate 20 contains inorganic particles. According to the thermal transfer sheet 100A of another embodiment comprising the dye primer layer 11 containing inorganic particles, it is possible to make a further improvement in the printing density when the dyes of the dye layer constituting the dye layer laminate 20 is allowed to diffuse and transfer onto the receiving layer 20 of the transfer layer 10 transferred onto a transfer receiving article to form a thermally transferable image.

Specifically, formation of the thermally transferable image using the thermal transfer sheet 100A of another embodiment is performed by transferring the transfer layer 10 onto a transfer receiving article, superposing the transfer layer 10 transferred and the dye layer laminate 20 of the thermal transfer sheet 100A of another embodiment, and applying heat to the back face side of the thermal transfer sheet 100A of another embodiment by a heating device such as a thermal head. In other words, formation of the thermally transferable image is performed such that the receiving layer 2 is sandwiched between the intermediate layer 3 and the dye primer layer 11.

In the thermal transfer sheet 100A of another embodiment herein, not only the intermediate layer 3 constituting the transfer layer 10 but also the dye primer layer 11 constituting the dye layer laminate 20 contains inorganic particles. Thus, when a thermally transferable image is formed, diffusion of the dye to the side of the receiving layer 2 can be effectively performed due to the action of the dye primer layer 11 containing inorganic particles, and on the side of the receiving layer 2, the diffusion efficiency of the dye in the receiving layer 2 can be improved due to the action of the intermediate layer 3. That is, a synergistic effect of the action of both the intermediate layer 3 and the dye primer layer 11 can greatly increase the printing density of the thermally transferable image to be formed on the receiving layer 2.

As the dye primer layer 11, the structure of the intermediate layer 3 which has been explained in relation to the thermal transfer sheet 100 of one embodiment described above can be used as it is. Thus, a detailed description for the dye primer layer is omitted here. The same applies to the preferable thickness of the dye primer layer 11 and the method for forming the dye primer layer 11. The dye primer layer 11 of an optimal embodiment contains either or both of a urethane-based resin and a polyvinyl pyrrolidone-based resin together with inorganic particles. According to the dye primer layer 11 of an optimal embodiment, it is possible to make a further improvement in the printing density of a thermally transferable image to be formed on the receiving layer. In the case where a resin component such as a urethane-based resin or a polyvinyl pyrrolidone-based resin is used in combination with inorganic particles, the content of the resin component is preferably in the range of 10% by mass or more and 95% by mass or less, more preferably in the range of 10% by mass or more and 80% by mass or less, based on the total mass of the inorganic particles and the resin component.

<<Thermal Transfer Image-Receiving Sheet>>

Subsequently, the thermal transfer image-receiving sheet of one embodiment of the present invention (hereinbelow, the sheet is referred to as the thermal transfer image-receiving sheet of one embodiment) will be described. As shown in FIG. 4, a thermal transfer image-receiving sheet 200 of one embodiment adopts a structure in which a pattern layer 40, a masking layer 4, an intermediate layer 3, and a first receiving layer 2 are provided in this order on a substrate 31 and a portion of the surface of the pattern layer 40 is exposed. The thermal transfer sheet 200 of one embodiment is characterized in that the intermediate layer 3 contains inorganic particles. FIG. 4 is a schematic sectional view of the thermal transfer image-receiving sheet of one embodiment.

According to the thermal transfer image-receiving sheet 200 of one embodiment having the above characteristic, it is possible to make an improvement in the printing density when a thermally transferable image is formed on the first receiving layer 2. The above-described effect in the thermal transfer image-receiving sheet 200 of one embodiment is caused by the action of the intermediate layer 3 constituting the transfer layer 10. This is the same reason described in the above thermal transfer sheet 100 of one embodiment.

The thermal transfer image-receiving sheet 200 of one embodiment adopts a structure in which a portion of the surface of the pattern layer 40 is exposed. This is because the surface of the pattern layer 40 is masked by the masking layer 4 in the case where the surface of the pattern layer 40 is not exposed. It is also possible to use a thermal transfer image-receiving sheet in which a masking layer is provided on the pattern layer 40 such that the surface of the pattern layer 40 is not exposed. According to this thermal transfer image-receiving sheet 200, for example, by forming a thermally transferable image on the receiving layer 2 of the thermal transfer image-receiving sheet 200 by using a substrate having transparency as the substrate 31, it is possible to obtain a printed product 300 which makes only the thermally transferable image visible from one surface of the substrate 31 and makes only the pattern layer 40 visible from the other surface of the substrate 31. Accordingly, in the method for forming a printed product described later, it is also possible to use a thermal transfer image-receiving sheet 200 in which the masking layer 4 is provided on the pattern layer 40 such that the surface of the pattern layer 40 is not exposed.

(Substrate of Thermal Transfer Image-Receiving Sheet)

There is no particular limitation with respect to the substrate 31 of the thermal transfer image-receiving sheet 200 (hereinbelow, the substrate is referred to as the substrate 31), and conventionally known substrates can be appropriately selected and used as the substrate of the thermal transfer image-receiving sheet. As the substrate 31 generally used in the field of thermal transfer image-receiving sheets, paper substrates such as wood-free paper, art paper, lightweight coated paper, lightly coated paper, coated paper, castcoated paper, synthetic resin or emulsion-impregnated paper, synthetic rubber latex-impregnated paper, and synthetic resin internally added paper can be exemplified. In addition to these, the substrate 1 described in the above thermal transfer sheet 100 of one embodiment can be used as it is.

(Pattern Layer)

The pattern layer 40 is provided on the substrate 31. The pattern layer 40 may be a layer on which some patterns are formed or a colored layer, and there is no limitation with respect to the pattern on the pattern layer 40.

Figure 5:
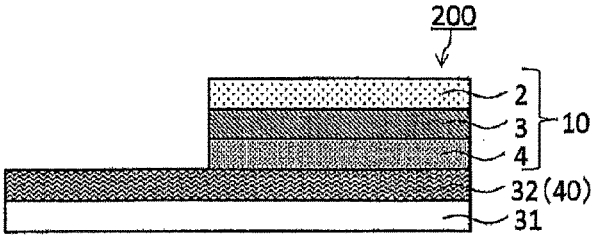
FIG. 5(*a*) is a schematic sectional view illustrating one example of a thermal transfer image-receiving sheet of one embodiment.
Figure 5:
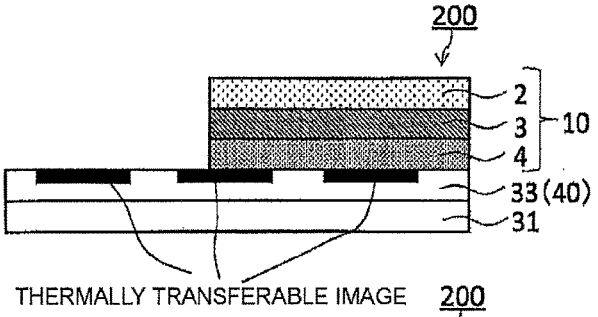
Figure 5:
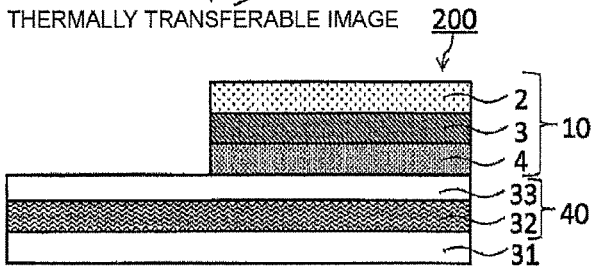

For example, as shown in FIG. 5(*a*), a conventionally known hologram layer 32 may be used as the pattern layer 40, or as shown in FIG. 5(*b*), a second receiving layer 33 on which a thermally transferable image is formed may be used as the pattern layer 40, or as shown in FIG. 5(*c*), a laminate in which the hologram layer 32 and the second receiving layer 33 are layered from the substrate 31 side may be used as the pattern layer 40. Instead of the embodiment shown in FIG. 5(*b*), the pattern layer 40 may be formed directly on the substrate 31 without providing the second receiving layer 33. The second receiving layer 33 in FIG. 5(*c*) is a receiving layer before a thermally transferable image is formed, but may be a receiving layer on which a thermally transferable image has been formed in advance. Using the second receiving layer 33 as the receiving layer before formation of a thermally transferable image enables formation of a thermally transferable image onto the first receiving layer 2 as well as formation of a thermally transferable image onto the second receiving layer 33. There is no limitation with respected to the second receiving layer 33, and conventionally known receiving layers can be appropriately selected and used as the receiving layer of the thermal transfer image-receiving sheet. For example, the receiving layer 2 described in the above thermal transfer sheet 100 of one embodiment can be used as it is. As the hologram layer 32, for example, a layer having an uneven pattern (interference fringes) or a sheet onto which a hologram as commercially available is formed may be used, and layers including a colored hologram such as gold-colored one, silver-colored one or the like colored by metal deposition may also be used. FIGS. 5(*a*) to (*c*) are schematic sectional views of the thermal transfer image-receiving sheet of one embodiment.

As the masking layer 4 and the intermediate layer 3, the masking layer 4 and the intermediate layer 3 described in the thermal transfer sheet of the above one embodiment can be used as they are. As the first receiving layer 2, the receiving layer 2 described in the thermal transfer sheet of the above one embodiment can be used as it is.

There is no particular limitation with respect to the method for forming the thermal transfer image-receiving sheet 200 of one embodiment, and a method in which, by using the thermal transfer sheet 100 of one embodiment described above, the transfer layer 10 of the thermal transfer sheet 100 is transferred onto the substrate 31 including the pattern layer 40 provided on the surface such that a portion of the surface of the pattern layer 40 is exposed, and a thermally transferable image is formed on the transfer layer 10 transferred and the like can be exemplified.

<<Method for Forming Printed Product>>

Subsequently, the method for forming a printed product of one embodiment of the present invention (hereinbelow, the method is referred to as the method for forming a printed product of one embodiment) will be described. The method for forming a printed product of one embodiment is characterized by comprising a step of providing a transfer receiving article on which a pattern layer is provided and a thermal transfer sheet in which a transfer layer in which a receiving layer, an intermediate layer containing inorganic particles, and a masking layer are layered in this order on the same surface of a substrate from the side of the substrate and a dye layer laminate in which a dye primer layer containing inorganic particles and a dye layer are layered in this order from the side of the substrate are provided successively in a surface by surface manner, a step of transferring the transfer layer of the thermal transfer sheet provided in the providing step on the pattern layer of the transfer receiving article provided in the providing step such that a portion of the surface of the pattern layer is exposed, and a step of forming a thermally transferable image on the transfer layer transferred onto the pattern layer by using the dye layer included in the laminate of the thermal transfer sheet provided in the providing step.

(Step of Providing Thermal Transfer Sheet)

The present step is a step of providing a transfer receiving article on which a pattern layer is provided and a thermal transfer sheet in which a transfer layer in which a receiving layer, an intermediate layer containing inorganic particles, and a masking layer are layered in this order on the same surface of a substrate from the side of the substrate and a dye layer laminate in which a dye primer layer containing inorganic particles and a dye layer are layered in this order from the side of the substrate are provided successively in a surface by surface manner.

As the transfer receiving article on which a pattern layer is provided, a transfer receiving article in which the pattern layer is provided on the substrate and the like can be exemplified. For example, the substrate 31, the pattern layer 40, and the like described in the above thermal transfer image-receiving sheet 200 of one embodiment may be appropriately selected to form a transfer receiving article including the pattern layer provided on the substrate. This pattern layer 40 includes a pattern layer 40 in which a thermally transferable image is finally formed to provide a pattern. Specifically, the pattern layer 40 may be a receiving layer before a thermally transferable image is formed. Alternatively, a plastic card mainly composed of plain paper, wood-free paper, tracing paper, a plastic film, vinyl chloride, a vinyl chloride-vinyl acetate copolymer, polycarbonate, and materials other than these is used as a transfer receiving article, onto which a pattern layer may be provided.

As the thermal transfer sheet, the above thermal transfer sheet 100A of another embodiment can be used as it is, and a detailed description for the sheet is omitted here.

(Step of Transferring)

The present step is a step of transferring the transfer layer of the thermal transfer sheet provided in the above providing step onto the pattern layer of the transfer receiving article provided in the same providing step such that a portion of the surface of the pattern layer is exposed. A thermal transfer image-receiving sheet formed by transferring the transfer layer onto the transfer receiving article including the pattern layer provided is obtained via the present step. In other words, the above thermal transfer image-receiving sheet of one embodiment is obtained. For transferring the transfer layer, in addition to methods in which a heating device such as a thermal head or the like is used, for example, the hot stamping method, the heat roll method, or the like may be employed. The transfer layer can also be transferred by methods other than these.

The intermediate layer constituting the transfer layer of the thermal transfer sheet provided in the above providing step, which contains inorganic particles, enables the transfer layer to be transferred, with a good foil tearing property, onto the transfer receiving article including the pattern layer in the transferring step.

(Step of Forming Thermally Transferable Image)

The present step is a step of forming a thermally transferable image on the receiving layer of the thermal transfer image-receiving sheet obtained in the above transferring step by using the dye layer constituting the dye layer laminate of the thermal transfer sheet provided in the above providing step. A printed product in which the masking layer, the intermediate layer, and the receiving layer are provided in this order on the transfer receiving article having the pattern layer such that a portion of the pattern layer is exposed and a thermally transferable image is formed on the receiving layer is obtained via the present step. The thermally transferable image can be formed by using a heating device such as a thermal head or the like. The thermally transferable image can also be formed by using a method other than these.

Figure 6:
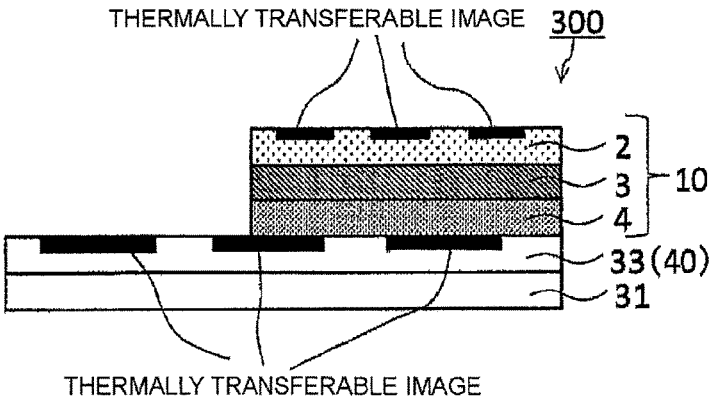
FIG. 6(*a*) is a schematic sectional view illustrating one example of a printed product formed by a method for forming a printed product of one embodiment.
Figure 6:
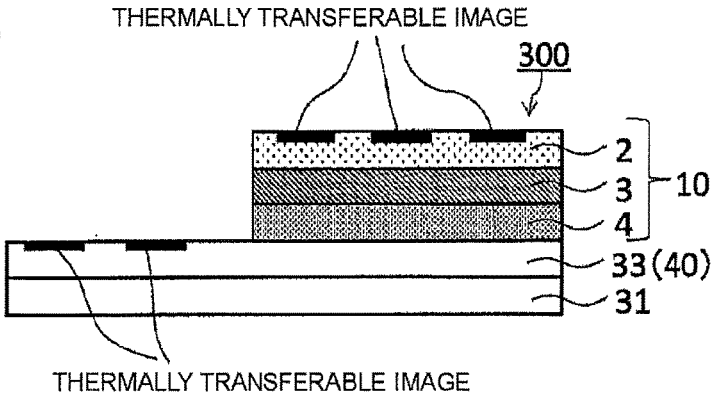

FIG. 6 is a schematic sectional view illustrating one example of a printed product 300 formed by the method for forming a printed product of one embodiment. In the case where the pattern layer 40 of the transfer receiving article provided in the providing step is the second receiving layer 33 including a thermally transferable image formed in advance, a thermally transferable image is formed on the receiving layer 2 provided on the intermediate layer 3 in the step of forming a thermally transferable image, and, as shown in FIG. 6(*a*), a printed product 300 in which a portion of the pattern layer 40 is masked by the masking layer 4 and a thermally transferable image is formed on the masking layer is obtained. In contrast, in the case where the pattern layer 40 of the transfer receiving article provided in the providing step is the second receiving layer 33 before a thermally transferable image is formed, in the step of forming a thermally transferable image, the thermally transferable image is formed on the second receiving layer 33 of the transfer receiving article of which surface is exposed and the thermally transferable image is formed also on the receiving layer 2 provided on the intermediate layer 3, and thus, a printed product 300 of the embodiment shown in FIG. 6(*b*) is obtained. The pattern layer 40 is not limited to the embodiment shown, and various forms of the pattern layer 40 described in the thermal transfer image-receiving sheet 200 of one embodiment can be appropriately selected and used.

In the method for forming a printed product of one embodiment described hereinabove, both the intermediate layer constituting the transfer layer of the thermal transfer sheet provided in the providing step and the dye primer layer constituting the dye layer laminate contain inorganic particles, and thus, a thermally transferable image having a high density can be formed on the receiving layer.

<<Printed Product>>

Subsequently, the printed product 300 of one embodiment of the present invention (hereinbelow, referred to as the printed product of one embodiment) will be described. As shown in FIGS. 6(*a*) and (*b*), the printed product 300 of one embodiment is characterized by having a thermally transferable image formed on the first receiving layer 2 of the thermal transfer image-receiving sheet 200 of one embodiment described above. In the thermal transfer image-receiving sheet of one embodiment, in which the intermediate layer containing inorganic particles is provided between the masking layer and the receiving layer, a thermally transferable image to be formed on the receiving layer has a high printing density, and consequently, the designability of the printed product can be improved.

EXAMPLES

Next, the present invention will be described more concretely with demonstrating examples. Unless otherwise specified below, the "part" and "%" are based on the mass. For components having a solid component ratio, a mass value in terms of solid content is indicated.

Example 1

Using a polyethylene terephthalate film of 5 μm in thickness as a substrate, the substrate was coated with a coating liquid for the back face layer having the following composition so as to reach 1.0 g/m$^2$ in a dried state, and a back face layer was formed. Then, the surface of the substrate opposite to the surface on which the back face layer was provided was coated with a coating liquid 1 for the first receiving layer having the following composition so as to reach 1.0 g/m$^2$ in a dried state, and a first receiving layer was formed. Then, the first receiving layer was coated with a coating liquid 1 for the first intermediate layer having the following composition so as to reach 0.15 g/m$^2$ in a dried state, and a first intermediate layer was formed. Then, the first intermediate layer was coated with a coating liquid for the masking layer having the following composition so as to reach 2.0 g/m$^2$ in a dried state, and a masking layer was formed. Thus, the thermal transfer sheet of Example 1 was obtained, wherein the transfer layer including the first receiving layer, the first intermediate layer, and the masking layer layered in this order was provided on one surface of the substrate and the back face layer was provided on the other surface of the substrate.

<Coating Liquid for the Back Face Layer>

| | |
|---|---|
| Polyvinyl butyral resin (S-LEC BX-1, SEKISUI CHEMICAL CO., LTD.) | 1.8 parts |
| Polyisocyanate (BURNOCK D750, DIC Corporation) | 5.5 parts |
| Phosphoric acid ester-based surfactant (PLYSURF A208N, DKS Co. Ltd.) | 1.6 parts |
| Talc (MICRO ACE P-3, NIPPON TALC Co., Ltd.) | 0.35 parts |
| Toluene | 18.5 parts |
| Methyl ethyl ketone | 18.5 parts |

<Coating Liquid 1 for the First Receiving Layer>

| | |
|---|---|
| Vinyl chloride-vinyl acetate copolymer resin (SOLBIN CNL, Nissin Chemical Co., Ltd.) | 15.8 parts |
| Vinyl chloride-vinyl acetate copolymer resin (SOLBIN C, Nissin Chemical Co., Ltd.) | 1.0 part |
| Epoxy aralkyl-modified silicone oil (X-22-3000T, Shin-Etsu Chemical Co., Ltd.) | 1.2 parts |
| Methyl styrene-modified silicone oil (X-24-510, Shin-Etsu Chemical Co., Ltd.) | 1.2 parts |
| Polyether modified-silicone oil (KF-352A, Shin-Etsu Chemical Co., Ltd.) | 0.8 parts |
| Methyl ethyl ketone | 40 parts |
| Toluene | 40 parts |

<Coating Liquid 1 for the First Intermediate Layer>

| | |
|---|---|
| Colloidal alumina (solid content 10.5%) (Alumina sol 200, Nissan Chemical Industries, Ltd.) | 5 parts |
| Water/isopropyl alcohol mixed solvent (1:1) | 95 parts |

<Coating Liquid for the masking layer>

| | |
|---|---|
| Acrylic-based resin | 3 parts |
| Vinyl chloride-vinyl acetate copolymer resin | 1 part |
| Titanium oxide | 16 parts |
| Methyl ethyl ketone | 40 parts |
| Toluene | 40 parts |

Example 2

The thermal transfer sheet of Example 2 was obtained totally in the same manner as in Example 1 except that the coating liquid 1 for the first intermediate layer was replaced by a coating liquid 2 for the first intermediate layer having the following composition.

<Coating Liquid 2 for the First Intermediate Layer>

| | |
|---|---|
| Water-based urethane resin (solid content 26%) (SUPERFLEX 650, DKS Co. Ltd.) | 4 parts |
| Colloidal alumina (solid content 10.5%) (Alumina sol 200, Nissan Chemical Industries, Ltd.) | 1 part |
| Water/isopropyl alcohol mixed solvent (1:1) | 95 parts |

Example 3

The thermal transfer sheet of Example 3 was obtained totally in the same manner as in Example 1 except that the coating liquid 1 for the first intermediate layer was replaced by a coating liquid 3 for the first intermediate layer having the following composition.

<Coating Liquid 3 for the First Intermediate Layer>

| | |
|---|---|
| Water-based urethane resin (solid content 22.5%) (HYDRAN AP-40, DIC Corporation) | 4 parts |
| Silica sol (particle size 10 to 15 nm, solid content 20%) (SNOWTEX N, Nissan Chemical Industries, Ltd.) | 1 part |
| Water/isopropyl alcohol mixed solvent (1:1) | 95 parts |

Example 4

The thermal transfer sheet of Example 4 was obtained totally in the same manner as in Example 1 except that the coating liquid 1 for the first intermediate layer was replaced by a coating liquid 4 for the first intermediate layer having the following composition.

<Coating Liquid 4 for the First Intermediate Layer>

| | |
|---|---|
| Water-based urethane resin (solid content 26%) (SUPERFLEX 650, DKS Co. Ltd.) | 1 part |
| Colloidal alumina (solid content 10.5%) (Alumina sol 200, Nissan Chemical Industries, Ltd.) | 4 parts |
| Water/isopropyl alcohol mixed solvent (1:1) | 95 parts |

Example 5

The thermal transfer sheet of Example 5 was obtained totally in the same manner as in Example 1 except that the coating liquid 1 for the first intermediate layer was replaced by a coating liquid 5 for the first intermediate layer having the following composition.

<Coating Liquid 5 for the First Intermediate Layer>

| | |
|---|---|
| Water-based urethane resin (solid content 22.5%) (HYDRAN AP-40, DIC Corporation) | 2.5 parts |
| Water-based silica dispersion (solid content 15%) (SUNLOVELY LFS HN-050, AGC Si-Tech Co., Ltd.) | 2.5 parts |
| Water/isopropyl alcohol mixed solvent (1:1) | 95 parts |

Example 6

The thermal transfer sheet of Example 6 was obtained totally in the same manner as in Example 1 except that the coating liquid 1 for the first intermediate layer was replaced by a coating liquid 6 for the first intermediate layer having the following composition.

<Coating Liquid 6 for the First Intermediate Layer>

| | |
|---|---|
| Vinyl acetate-vinyl pyrrolidone copolymer (solid content 50%) (PVP/VA E355, Isp Japan Ltd.) | 1 part |
| Colloidal alumina (solid content 10.5%) (Alumina sol 200, Nissan Chemical Industries, Ltd.) | 4 parts |
| Water/isopropyl alcohol mixed solvent (1:1) | 95 parts |

Examples 7 to 9

The thermal transfer sheets of Examples 7 to 9, in which the transfer layer obtained in the same manner as in the above Example 4 and the dye layer laminate formed by dye layers of each color layered on the dye primer layer were provided on one surface of the substrate successively in a surface by surface manner and the back face layer was provided on the other surface of the substrate, were obtained in the same manner as in above Example 4 except that, using coating liquids 1 to 3 for the dye primer layer having the following composition (coating liquid 1 for the dye primer layer for Example 7, coating liquid 2 for the dye primer layer for Example 8, and coating liquid 3 for the dye primer layer for Example 9), one surface of the substrate was coated with these coating liquids successively in a surface by surface manner with the above transfer layer, so as to reach 0.15 g/m$^2$ in a dried state to form a dye primer layer and then, the dye primer layer was coated with coating liquids for yellow, magenta, and cyan dye layer having the following composition successively in a surface by surface manner so as to reach 0.7 g/m$^2$ to form a yellow dye layer, a magenta dye layer, and a cyan dye layer.

<Coating Liquid 1 for the Dye Primer Layer>

| | |
|---|---|
| Water-based urethane resin (solid content 26%) (SUPERFLEX 650, DKS Co. Ltd.) | 1 part |
| Colloidal alumina (solid content 10.5%) (Alumina sol 200, Nissan Chemical Industries, Ltd.) | 4 parts |
| Water/isopropyl alcohol mixed solvent (1:1) | 95 parts |

<Coating Liquid 2 for the Dye Primer Layer>

| | |
|---|---|
| Water-based urethane resin (solid content 26%) (SUPERFLEX 650, DKS Co. Ltd.) | 4 parts |
| Colloidal alumina (solid content 10.5%) (Alumina sol 200, Nissan Chemical Industries, Ltd.) | 1 part |
| Water/isopropyl alcohol mixed solvent (1:1) | 95 parts |

<Coating Liquid 3 for the Dye Primer Layer>

| | |
|---|---|
| Vinyl acetate-vinyl pyrrolidone copolymer (solid content 50%) (PVP/VA E355, Isp Japan Ltd.) | 1 part |
| Colloidal alumina (solid content 10.5%) (Alumina sol 200, Nissan Chemical Industries, Ltd.) | 4 parts |
| Water/isopropyl alcohol mixed solvent (1:1) | 95 parts |

<Coating Layer for Yellow Dye Layer>

| | |
|---|---|
| Solvent yellow 93 | 5 parts |
| Polyvinyl acetoacetal resin (KS-5, SEKISUI CHEMICAL CO., LTD.) | 4 parts |
| Toluene | 50 parts |
| Methyl ethyl ketone | 50 parts |

<Coating Liquid for the Magenta Dye Layer>

| | |
|---|---|
| Disperse Red 60 | 3 parts |
| Disperse Violet 26 | 3 parts |
| Polyvinyl acetoacetal resin (KS-5, SEKISUI CHEMICAL CO., LTD.) | 5 parts |
| Toluene | 50 parts |
| Methyl ethyl ketone | 50 parts |

<Coating Liquid for the Cyan Dye Layer>

| | |
|---|---|
| Solvent blue 63 | 3 parts |
| Disperse Blue 354 | 2.5 parts |
| Polyvinyl acetoacetal resin (KS-5, SEKISUI CHEMICAL CO., LTD.) | 5 parts |

-continued

| | |
|---|---|
| Toluene | 50 parts |
| Methyl ethyl ketone | 50 parts |

Comparative Example 1

The thermal transfer sheet of Comparative Example 1 was obtained totally in the same manner as in Example 1 except that no first intermediate layer was formed.

Comparative Example 2

The thermal transfer sheet of Comparative Example 2 was obtained totally in the same manner as in Example 1 except that the coating liquid 1 for the first intermediate layer was replaced by a coating liquid A for the first intermediate layer having the following composition.

<Coating Liquid A for the First Intermediate Layer>

| | |
|---|---|
| Water-based urethane resin (solid content 26%) (SUPERFLEX 650, DKS Co. Ltd.) | 4 parts |
| Organic particulates (spherical particulates constituted by a melamine-formaldehyde condensate (average particle size 0.1 to 0.3 μm) (EPOSTAR S, NIPPON SHOKUBAI CO., LTD.) | 1 part |
| Water/isopropyl alcohol mixed solvent (1:1) | 95 parts |

Comparative Example 3

The thermal transfer sheet of Comparative Example 3 was obtained totally in the same manner as in Example 1 except that the coating liquid 1 for the first intermediate layer was replaced by a coating liquid B for the first intermediate layer having the following composition.

<Coating Liquid B for the First Intermediate Layer>

| | |
|---|---|
| Water-based urethane resin (solid content 26%) (SUPERFLEX 650, DKS Co. Ltd.) | 5 parts |
| Water/isopropyl alcohol mixed solvent (1:1) | 95 parts |

Comparative Example 4

The thermal transfer sheet of Comparative Example 4 was obtained totally in the same manner as in Example 1 except that the coating liquid 1 for the first intermediate layer was replaced by a coating liquid C for the first intermediate layer having the following composition.

<Coating Liquid C for the First Intermediate Layer>

| | |
|---|---|
| Water-based urethane resin (solid content 22.5%) (HYDRAN AP-40, DIC Corporation) | 5 parts |
| Water/isopropyl alcohol mixed solvent (1:1) | 95 parts |

<Formation of Transfer Receiving Article>

Using a polyethylene terephthalate film of 25 μm in thickness as a substrate, this substrate was coated with a coating liquid for the hologram layer having the following composition by the gravure coating method so as to reach an amount for coating of 2 g/m$^2$ in a dried state. Using a metal sheet on which interference fringes of a hologram had been unevenly formed, the layer after coating was embossed to impart unevenness of the hologram thereto, and thereby a hologram layer was formed. Thereafter, on the surface of the hologram layer onto which the unevenness had been imparted, aluminum was vapor-deposited so as to obtain a thickness of 30 nm to form a reflective layer, and thus, a hologram sheet in which the substrate, the hologram layer, and the reflective layer were layered in this order was obtained.

<Coating Liquid for the Hologram Layer>

| | |
|---|---|
| Acryl resin | 40 parts |
| Melamine resin | 10 parts |
| Cyclohexanone | 50 parts |
| Methyl ethyl ketone | 50 parts |

Subsequently, using RC paper (STF-150, manufactured by Mitsubishi Paper Mills Limited, 190 μm) as a support, this support was coated with a coating liquid for the adhesive layer having the following composition by the gravure coating method so as to reach an amount for coating of 3.0 $g/m^2$ in a dried state to form an adhesive layer. The hologram sheet obtained above was laminated using the adhesive layer such that the reflective layer of the hologram sheet was opposed to the support to thereby obtain a laminate (support/adhesive layer/reflective layer/hologram layer/substrate).

<Coating Liquid for the Adhesive Layer>

| | |
|---|---|
| Polyfunctional polyol (TAKELAC A-969-V, Takeda Pharmaceutical Company Limited.) | 30 parts |
| Isocyanate (TAKELAC A-5, Takeda Pharmaceutical Company Limited.) | 10 parts |
| Ethyl acetate | 60 parts |

Subsequently, the substrate of the laminate (support/adhesive layer/reflective layer/hologram layer/substrate) obtained above was coated with a coating liquid for the second intermediate layer having the following composition by the gravure coating method so as to reach an amount for coating of 1.2 $g/m^2$ in a dried state to form a second intermediate layer. The second intermediate layer was coated with a coating liquid for the second receiving layer having the following composition by the gravure coating method so as to reach an amount for coating of 4.0 $g/m^2$ in a dried state to form the second receiving layer, and thus, the transfer receiving article in which the support/adhesive layer/reflective layer/hologram layer/substrate/second intermediate layer/second receiving layer were layered in this order was obtained.

<Coating Liquid for the Second Intermediate Layer>

| | |
|---|---|
| Water-dispersed polyester resin (solid content 25%, Tg 20° C.) (VYLONAL MD-1480, TOYOBO CO., LTD.) | 10 parts |
| Electrically conductive synthetic layer silicate (average primary particle size 25 nm) (LAPONITE JS, Wilbur-Ellis) | 10 parts |
| Water | 80 parts |

<Coating Liquid for the Second Receiving Layer>

| | |
|---|---|
| Vinyl chloride-vinyl acetate copolymer (SOLBIN C, Nissin Chemical Co., Ltd.) | 15 parts |
| Silicone (X-22-3000T, Shin-Etsu Chemical Co., Ltd.) | 0.75 parts |
| Silicone (X-24-510, Shin-Etsu Chemical Co., Ltd.) | 0.1 parts |
| Methyl ethyl ketone | 33 parts |
| Toluene | 33 parts |

(Evaluation of Foil Tearing Property)

The transfer receiving article produced above was combined with the thermal transfer sheet of each of Examples and Comparative Examples. Using a printer described below, under 180/255 gray-scale image conditions, the transfer layer was transferred onto a portion of a region on the second receiving layer of the transfer receiving article produced above so as to form a fine line, and the thermal transfer image-receiving sheet of each of Examples 1 to 9 and Comparative Examples of 1 to 4 was obtained. The condition of the transfer layer of the thermal transfer image-receiving sheet of each of Examples 1 to 9 and Comparative Examples of 1 to 4 was visually observed, and the foil tearing property of the transfer layer was evaluated based on the following evaluation criteria. Evaluation results are shown in Table 1.

(Printer)

Thermal head: KEE-57-12GAN2-STA (manufactured by KYOCERA Corporation

Heater average resistance: 3303 (Ω)

Main scanning direction printing density: 300 dpi

Sub scanning direction printing density: 300 dpi

Printing voltage: 18 (V)

One line cycle: 1.5 (msec.)

Printing start temperature: 35 (° C.)

Pulse-Duty ratio: 85%

"Evaluation Criteria"

. . . The 3-dot fine line is transferred and there is no collapse in the 3-dot-dropped fine line.

○ . . . The 4-dot fine line is transferred and there is no collapse in the 4-dot-dropped fine line.

× . . . Tailing occurs around the 4-dot fine line. Alternatively, the 4-dot-dropped fine line is completely collapsed.

<Evaluation of Printing Density>

By combining the transfer receiving article produced above with the thermal transfer sheet of each of Examples 1 to 9 and Comparative Examples 1 to 4 and using the printer described above, under 180/255 gray-scale image conditions, the transfer layer was transferred onto the second receiving layer of the transfer receiving article produced above such that a portion of the surface of the second receiving layer was exposed, and the thermal transfer image-receiving sheet of each of Examples 1 to 9 and Comparative Examples 1 to 4 was obtained. Subsequently, by combining a thermal transfer sheet (i) produced by the following method and using the printer described above, an image was formed onto first receiving layer of the thermal transfer image-receiving sheet under 255/255 gray-scale image conditions to obtain a printed product of each of Examples 1 to 9 and Comparative Examples 1 to 4. For the thermal transfer image-receiving sheet of each of Examples 7 to 9, the thermal transfer sheet of each of Examples 7 to 9 obtained above was used instead of the thermal transfer sheet (i) produced by the following method. Specifically, the thermal transfer image-receiving sheet of Examples 7 was combined with the thermal transfer sheet of Examples 7, the thermal transfer image-receiving sheet of Examples 8 was combined with the thermal transfer sheet of Examples 8, and the thermal transfer image-receiving sheet of Examples 9 was combined with the thermal transfer sheet of Examples 9, to obtain a printed product of each of Examples 7 to 9. Also as shown in the following Table 1, the thermal transfer image-receiving sheet of each of Examples 1 to 6 was combined with a thermal transfer sheet (ii) produced by the following method to form a printed product of each of Examples 1 to 6. The density of the image on the obtained printed product of each of Examples and Comparative Examples was measured with a spectrometer (manufactured by X-Rite, i1), and density evaluation was carried out based on the following evaluation criteria. Evaluation results are shown in Table 1. As the criteria of density evaluation, the density of the printed product of Comparative Examples 1 was used.

(Production of Thermal Transfer Sheet (i))

Using a polyethylene terephthalate film of 5 μm in thickness as a substrate, this substrate was coated with a coating liquid for the back face layer having the above composition so as to reach 1.0 g/m$^2$ in a dried state, and a back face layer was formed. Then, the other surface of the substrate was coated with a coating liquid 4 for the dye primer layer having the following composition so as to reach 0.15 g/m$^2$ in a dried state, and a dye primer layer was formed. This dye primer layer was coated with coating liquids for yellow, magenta, and cyan dye layer having the above composition successively in a surface by surface manner so as to reach 0.7 g/m$^2$ in a dried state to form a yellow dye layer, a magenta dye layer, and a cyan dye layer, and a thermal transfer sheet (i) was obtained.

<Coating Liquid 4 for the Dye Primer Layer>

| | |
|---|---|
| Water-based urethane resin (solid content 22.5%) (HYDRAN AP-40, DIC Corporation) | 5 parts |
| Water/isopropyl alcohol mixed solvent (1:1) | 95 parts |

(Production of Thermal Transfer Sheet (ii))

A thermal transfer sheet (ii) was obtained totally in the same manner as in Production of thermal transfer sheet (i) except that the coating liquid 4 for the dye primer layer was replaced by a coating liquid 5 for the dye primer layer having the following composition.

<Coating Liquid 5 for the Dye Primer Layer>

| | |
|---|---|
| Water-based urethane resin (solid content 26%) (SUPERFLEX 650, DKS Co. Ltd.) | 4 parts |
| Organic particulates (spherical particulates constituted by a melamine-formaldehyde condensate (average particle size 0.1 to 0.3 μm) (EPOSTAR S, NIPPON SHOKUBAI CO., LTD.) | 1.0 part |
| Water/isopropyl alcohol mixed solvent (1:1) | 95 parts |

<<Evaluation Criteria>>

. . . 110% or more based on the reference concentration

○ . . . 105% or more and less than 110% based on the reference concentration

Δ . . . 100% or more and less than 105% based on the reference concentration

× . . . Less than 100% based on the reference concentration

TABLE 1

| | Foil tearing | Printing density evaluation | |
|---|---|---|---|
| | property | Thermal transfer sheet used | Evaluation |
| Example 1 | | Thermal transfer sheet (i) | ○ |
| | | Thermal transfer sheet (ii) | ○ |
| Example 2 | | Thermal transfer sheet (i) | ○ |
| | | Thermal transfer sheet (ii) | ○ |
| Example 3 | | Thermal transfer sheet (i) | ○ |
| | | Thermal transfer sheet (ii) | ○ |
| Example 4 | | Thermal transfer sheet (i) | ○ |
| | | Thermal transfer sheet (ii) | ○ |
| Example 5 | ○ | Thermal transfer sheet (i) | ○ |
| | | Thermal transfer sheet (ii) | ○ |
| Example 6 | | Thermal transfer sheet (i) | ○ |
| | | Thermal transfer sheet (ii) | ○ |
| Example 7 | | Thermal transfer sheet 7 | |
| Example 8 | | Thermal transfer sheet 8 | |
| Example 9 | | Thermal transfer sheet 9 | |
| Comparative Example 1 | x | Thermal transfer sheet (i) | Reference |
| Comparative Example 2 | x | Thermal transfer sheet (i) | Δ |
| Comparative Example 3 | x | Thermal transfer sheet (i) | Δ |
| Comparative Example 4 | x | Thermal transfer sheet (i) | Δ |

REFERENCE SIGNS LIST

100, 100A Thermal transfer sheet
1 Substrate
2 Receiving layer, First receiving layer
3 Intermediate layer
4 Masking layer
10 Transfer layer
11 Dye primer layer
12 Dye layer
12Y Yellow dye layer
12M Magenta dye layer
12C Cyan dye layer
13 Protective layer
20 Dye layer laminate
200 Thermal transfer image-receiving sheet
31 Substrate of thermal transfer image-receiving sheet
32 Hologram layer
33 Second receiving layer
40 Pattern layer

The invention claimed is:

1. A thermal transfer image-receiving sheet comprising:

a pattern layer, a masking layer, an intermediate layer, and a first receiving layer provided in this order on a substrate;

wherein a portion of the surface of the pattern layer is exposed, wherein the intermediate layer contains inorganic particles, and wherein the pattern layer is a pattern layer in which a hologram layer and a second receiving layer are layered from the top of the substrate.

2. A method for forming a printed product, comprising preparing a transfer receiving article and a thermal transfer sheet, the transfer receiving article being provided with a pattern layer, the thermal transfer sheet having a thermal transfer layer and a dye layer laminate formed on a same surface of a substrate frame sequentially, the thermal transfer layer comprising a receiving layer, an intermediate layer containing inorganic particles, and a masking layer layered in this order from the surface of the substrate, the dye layer laminate comprising a dye primer layer containing inorganic particles and a dye layer layered in this order from the surface of the substrate;

transferring the transfer layer of the thermal transfer sheet on the pattern layer as being exposed a portion of the surface of the pattern layer externally; and forming a thermally transferable image on the transfer layer transferred onto the pattern layer by using the dye layer included in the dye layer laminate of the thermal transfer sheet.

3. A thermal transfer image-receiving sheet comprising;

a pattern layer, a masking layer, an intermediate layer, and a first receiving layer provided in this order on a substrate;

wherein a portion of the surface of the pattern layer is exposed, wherein the intermediate layer contains inorganic particles, wherein the inorganic particles are inorganic particles derived from colloidal inorganic particles, and wherein the pattern layer is a pattern layer in which a hologram layer and a second receiving layer are layered from the top of the substrate.

4. A printed product comprising:

a thermally transferable image formed on a first receiving layer of a thermal transfer image-receiving sheet, wherein the thermal transfer image-receiving sheet comprises a pattern layer, a masking layer, an intermediate layer, and a first receiving layer provided in this order on a substrate, wherein a portion of the surface of the pattern layer is exposed, wherein the intermediate layer contains inorganic particles, and wherein the pattern layer is a pattern layer in which a hologram layer and a second receiving layer are layered from the top of the substrate.

* * * * *